United States Patent [19]

Rowland

[11] Patent Number: 4,554,695

[45] Date of Patent: Nov. 26, 1985

[54] VEHICULAR ROAD BLOCK

[76] Inventor: W. Ross Rowland, 639 River Bend Rd., Great Falls, Va. 22066

[21] Appl. No.: 576,706

[22] Filed: Feb. 3, 1984

[51] Int. Cl.[4] ..... E01D 1/00; E01F 13/00

[52] U.S. Cl. ..... 14/69.5; 404/6; 404/11; 52/232; 49/33

[58] Field of Search ..... 404/6, 9–11; 49/33, 49, 131, 132; 194/DIG. 23; 14/69.5, 71.1, 71.3; 52/174, 232; 43/58, 61, 69, 70

[56] References Cited

U.S. PATENT DOCUMENTS

| | | | |
|---|---|---|---|
| 815,663 | 3/1906 | Walker et al. | 48/69 |
| 1,217,381 | 2/1917 | Zubryd | 49/33 X |
| 2,107,080 | 2/1938 | Mitchell | 43/70 X |
| 2,643,010 | 6/1953 | Hott et al. | 14/69.5 X |
| 2,917,283 | 12/1959 | Sumners | 49/33 X |
| 3,530,488 | 9/1970 | Beckwith | 14/71.3 |
| 4,332,503 | 6/1982 | Hurst Jr. | 404/11 |
| 4,367,975 | 1/1983 | Tyers | 404/11 X |
| 4,429,483 | 2/1984 | Murakami | 43/70 |
| 4,472,908 | 9/1984 | Wanzl et al. | 49/49 X |

FOREIGN PATENT DOCUMENTS

| | | | |
|---|---|---|---|
| 2946270 | 5/1981 | Fed. Rep. of Germany | 49/49 |

*Primary Examiner*—Stephen J. Novosad
*Assistant Examiner*—Beverly E. Hjorth
*Attorney, Agent, or Firm*—Ziems, Walter & Shannon

[57] ABSTRACT

A road block for preventing unauthorized vehicles from entering a secured area comprises a pit, a span covering the pit, collapsible support members supporting the span at the trailing end of the plate with respect to the direction of vehicle access, devices for collapsing the support members, and a triggering mechanism for actuating the collapsing devices in response to the approach of an unauthorized vehicle.

18 Claims, 6 Drawing Figures

VEHICULAR ROAD BLOCK

BACKGROUND OF THE INVENTION

The present invention relates to the protection of buildings, other important sites and their occupants from attach from vehicles, and more particularly, to an aesthetically inoffensive vehicular road block for stopping unauthorized vehicles from entering a protected area.

In recent years, embassies, military installations and the residences of government officials have been subjected increasingly to terrorist attacks. One type of attack which is especially damaging and difficult to stop is the driving onto protected grounds of a vehicle loaded with explosives by a kamikaze driver who sacrifices his life by detonating the explosives when the vehicle is at or near the intended target. Ordinary lift gates and even swinging or sliding steel gates provided at the perimeter of the protected area are insufficient to stop a heavy vehicle moving at high speed. Heavier barricades made of material such as steel-reinforced concrete could be constructed to stop such vehicles, but they impede the flow of traffic of authorized vehicles into and out of the protected area and they detract from the appearance of the protected area. These drawbacks are unacceptable because the protected areas often include buildings with governmental or historical significance which must appear aesthetically pleasing, open and accessible to the people they serve.

SUMMARY OF THE INVENTION

In accordance with the present invention, the problems associated with protecting roadway access to sites by unauthorized vehicles are substantially overcome by a vehicular road block which is enabled as a barrier or disabled for passage of authorized vehicles easily and without visible change in appearance other than an open or closed condition of an associated gate, for example. Thus, no obstruction is presented to roadway access to the site by authorized vehicular traffic when the road block is disabled. Also, other than the closed gate, the enabled state of the road block will not be visible to one in an unauthorized vehicle.

The road block is embodied as a pit in a site access roadway covered at all times by a vehicle supporting span at a roadway grade or flush with the road pavement, for example. The span is supported by a permanent abutment at the leading end thereof in the context of the direction of vehicle travel for access to the protected site. The trailing end of the span, however, is supported by an abutment support which may be enabled for collapse upon a signal developed, for example, by passage of a vehicle through a closed gate positioned ahead of the pit, again in the context of vehicle access direction. Upon collapse of the support for the trailing end of the span, an unauthorized vehicle will incur a ramp downwardly inclined ending with the trailing end wall of the pit and thus, blocked from further movement.

A principal objective of the present invention, therefore, is to provide an improved road block to positively obstruct access to a protected site to unauthorized vehicles while allowing access to authorized vehicles and presenting an aesthetically inoffensive appearance. Other objects and further scope of applicability of the present invention will become apparent from the detailed description to follow taken in conjunction with the accompanying drawings in which like parts are designated by like reference numerals.

DETAILED DESCRIPTION OF THE PREFERRED EMBODIMENTS

Figure 1:
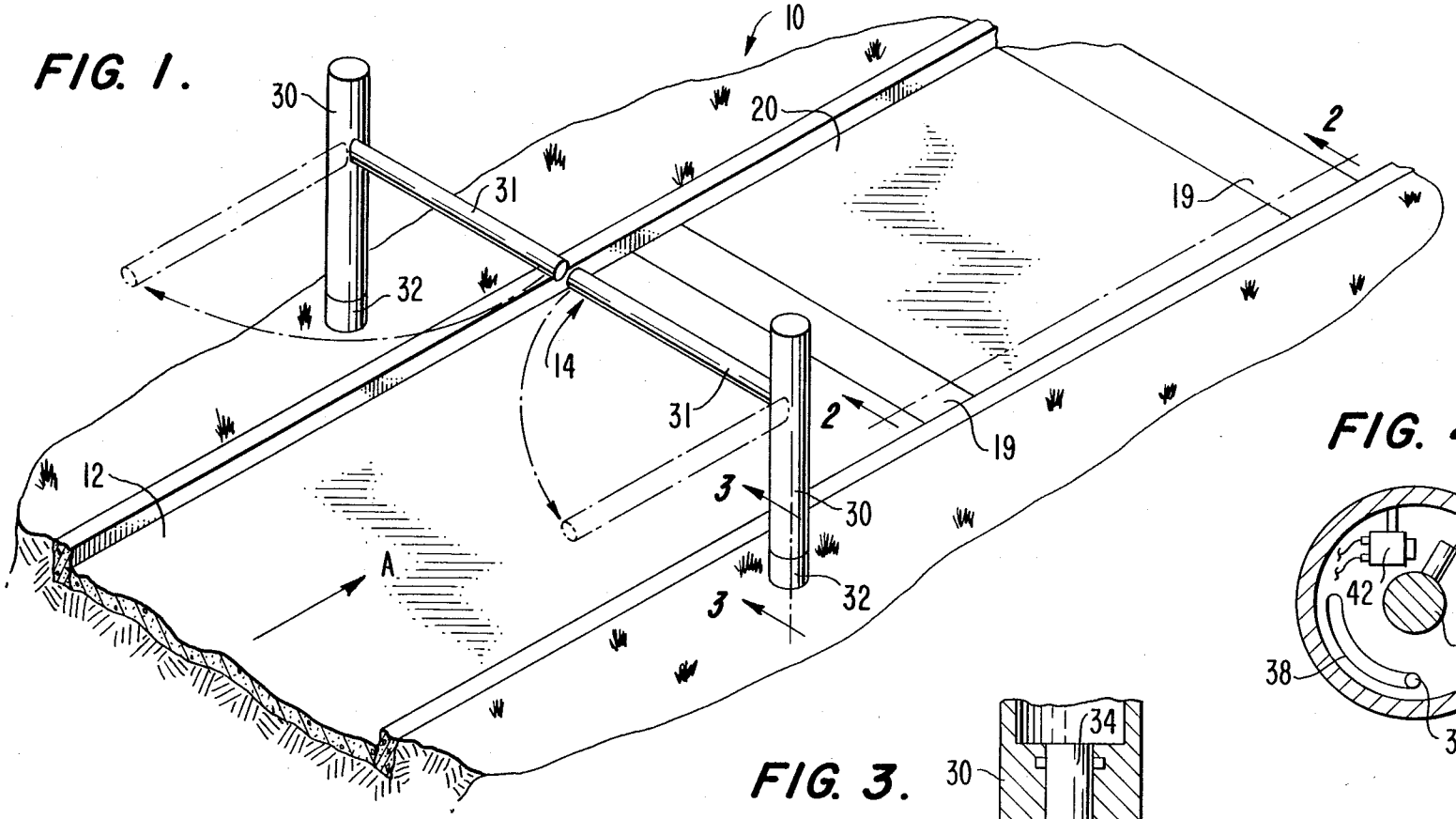
FIG. 1 is a perspective view of the vehicular road block according to the present invention.

As can be seen from FIG. 1, the vehicular road block, which is designated generally by the reference numeral 10, is a section of a road 12 providing access to a secured area. A gate 14 or other barrier device may be provided across the road 12 adjacent to the rest of the road block 10, on its leading side with respect to the direction of vehicle access to the protected area, in order to obtensibly deny access to the secured area to unauthorized vehicles travelling in the direction of the arrow A. It is understood, although not illustrated, that a wall or other structures defining a solid barrier protect most of the perimeter of the secured area, thereby restricting access to roads like the road 12 which employ a vehicular road block. Thus, in FIG. 1 the solid barrier would extend up to the gate 14 on both sides.

Figure 2:
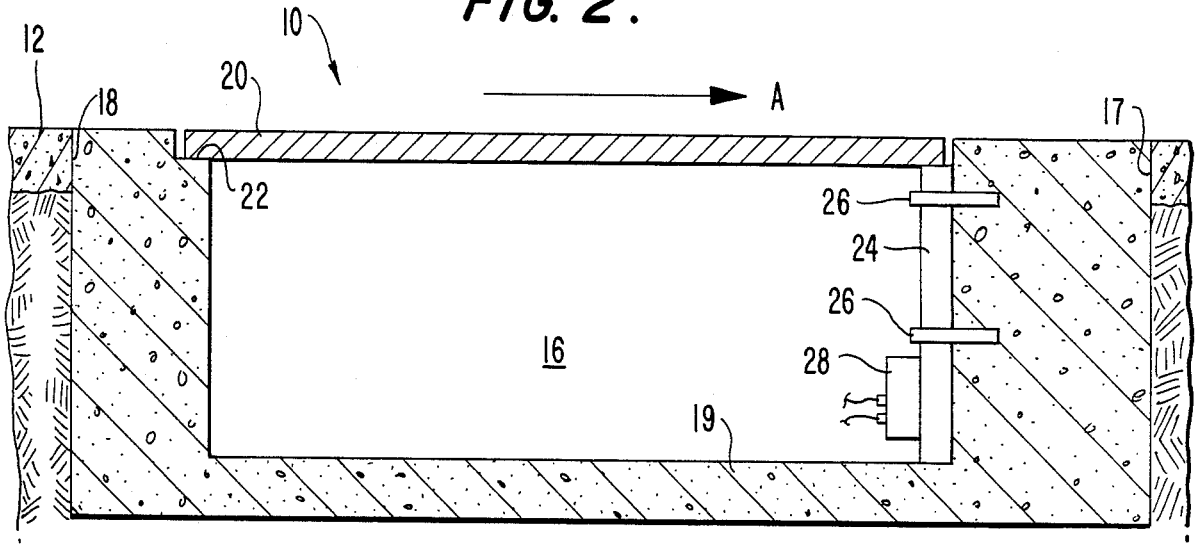
FIG. 2 is a cross section of the vehicular road block taken along the line 2—2 in FIG. 1.

As can best be seen from FIG. 2, the road block 10 includes a pit 16, which may include a rigid liner 19 of concrete or other material. The pit 16 is defined in part by a trailing wall 17 on a trailing end of the pit 16 with respect to the vehicle access direction and a leading wall 18 on the leading end of the pit. The pit 16, and the liner 19, if used, should be at least wider than the vehicles from which the secured area is to be protected and preferably as wide as the access road 12. A span 20, such as a plate of steel or other structure strong enough to support the weight of vehicular traffic on the road 12 is supported over the pit 16 flush with the surface of the road, thereby concealing the pit 16. Trusses or other strengthening devices may be included in the span 20, and asphalt, concrete, gravel or other material may be place on top of the span to match the surface of the road 12 for increased concealment of the road block 10. The span 20 should be slightly narrower than the pit 16, or slightly narrower than the liner 19 where a liner is used, so that the trailing end of the span 20 can fall into the pit 16. An abutment support is provided at the leading edge of the pit 16 to support the leading end of the span 20. Although the abutment support or supports may be separate from the leading wall 18 of the pit 16 and from the liner 19, in the embodiment illustrated in FIG. 2 the leading wall of the liner 19 itself is the abutment support. A shoulder 22 is defined in the liner 19 at the leading end of the pit 16 in order to support the leading end of the span 20. It can be appreciated that the shoulder can be provided at the top of the leading wall of earth defining the pit where a linear is not used. The trailing end of the span 20 is positioned just short of the trailing wall of the liner 19, where it is supported by one or more collapsible support members. In the embodiment illustrated, the collapsible support members, one of which is shown, comprise columns 24 secured to the trailing wall of the liner 19, with their bottom ends resting on the floor of the liner 19 and their top ends terminating at a level even with the surface of the shoulder 22. The columns 24 are secured to the trailing wall of the liner 19 by frangible fasteners, such as frangible brackets 26, so that their top ends provide a solid support for the trailing end of the span 20. A suitable explosive charge is provided for quickly and positively collapsing the columns 24 and the frangible brackets 26 in case a vehicle attempts to break into the secured area. In the embodiment of FIG. 2, the explosive charge includes an electrically detonated squib 28 mounted on each of the columns 24.

Figure 4:
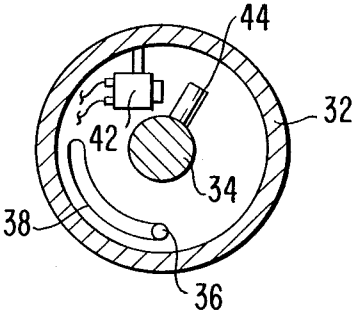
FIG. 4 is a cross section of the gate standard of FIG. 3 taken along the line 4—4.
Figure 3:
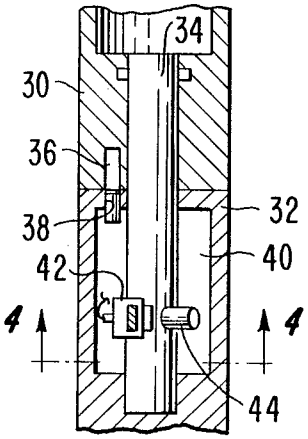
FIG. 3 is a partial cross section of a gate standard taken along the line 3—3 of FIG. 1.

As can be seen from FIGS. 1, 3 and 4, the road block 10 includes a mechanism for triggering or detonating the squibs 28 in response to the approach of an unauthorized vehicle. The gate 14 of FIG. 1, which is a part of the detonating mechanism, includes a pair of pivotable posts 30, one post 30 positioned on each side of the road 12 outside the span 20, and a horizontal bar 31 projecting from each post 30. In normal operation, the posts 30 are pivotable between the positions shown in solid lines, in which the bars 31 extend across the road 12 to prevent access to the secured area, and the positions shown in phantom lines, in which the bars 31 extend parallel to the sides of the road 10 to allow access to authorized vehicles. Each post 30 is pivotally mounted on a base 32 by a shaft 34, which is keyed or otherwise secured to the post 30 for movement with the post and is journalled for rotation in the base 32. A shear pin 36 mounted in the bottom of the post 30 extends down into a slot 38 defined in the top of the base 32. A cavity 40 is defined in the base 32, in which a limit switch 42 is mounted. A contact pin 44 extends radially from the shaft 34 and sweeps an arc which lies in the horizontal plane occupied by the limit switch 42. FIGS. 3 and 4 show the relative positions of the post 30 and base 32, when the gate 14 is in its closed position preventing access to the secured area. The shear pin 36 is at its limit, in the counterclockwise direction in FIG. 4, in the slot 38, and the contact pin 44 is at its normal counterclockwise limit adjacent to the limit 42. The engagement of the shear pin 36 with the end of the slot 38 prevents the contact pin 44 from actuating the limit switch 42. The engagement also prevents the posts 30 and the bars 31 from being pivoted inwardly toward the secured area beyond the positions shown in solid lines in FIG. 1. However, the force of a vehicle pushing the bars 31 inward toward the protected area is sufficient to shear the shear pin 36 and cause the contact pin 44 to actuate the limit switch 42. The actuation of the limit switch 42 detonates the squibs 28, thereby collapsing the columns 24 and causing the trailing end of the span 20 to fall into the pit 16. The span 20 acts as a ramp, directing the vehicle down into the pit 16 for impact against the trailing wall of the liner 19.

The mechanism just described for detonating the squibs 28 is provided as an example. Other switch arrangements involving swinging or sliding gates or other movable barricades may be employed. Alternatively, no movable barricade need be employed, and the detonating mechanism can include a proximity switch, photoelectric cell or other device. Still further, proximity switches, photoelectric cells or other devices can be employed in connection with movable barriers.

Figure 5:
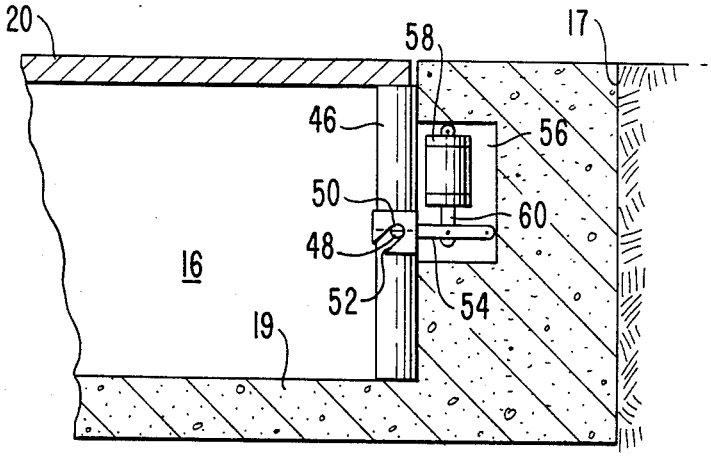
FIG. 5 is a partial cross section of an alternate embodiment of the vehicular road block according to the present invention.
Figure 6:
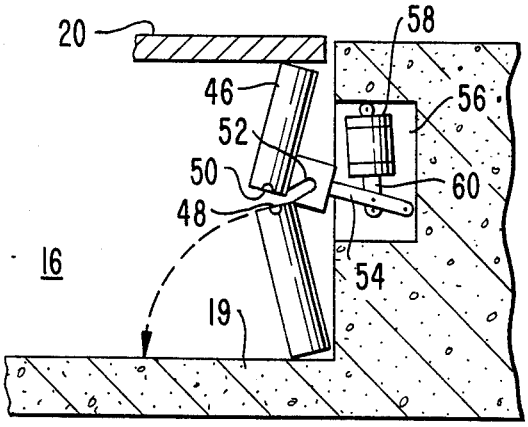
FIG. 6 is a partial cross section of the alternate embodiment of FIG. 5, but showing the support elements in the process of collapsing.

Collapsible support members other than the columns 24 can be employed. As can be seen from FIGS. 5 and 6, an alternate embodiment of the road block 10 can be constructed employing collapsible support members in the form of columns 46, each comprising an upper section resting on a separate lower section. A semi-cylindrical pin 48 extends laterally from the top of the lower section, and a complementary semi-cylindrical pin 50 extends from the bottom of the upper section, the pin 50 overlying the pin 48 so that the two pins together define an articulated cylindrical pin. The pins 48 and 50 are held together and, thus, the columns 46 are maintained in vertical alignment by an open-ended diagonal slot 52 defined in an actuating arm 54. The actuating arm 54 is pivotally anchored at an end opposite the diagonal slot 52 in a recess 56 in the trailing wall of the liner 19. A solenoid 58 is mounted in the recess 56 and includes a plunger 60 pivotally connected to the actuating arm 54 between its ends. As can be seen from FIG. 6, when the solenoid 58 is actuated by the approach of an unauthorized vehicle, the plunger 60 pivots the actuating arm 54 upward, thereby moving the diagonal slot 52 upward from the pins 48 and 50. This upward movement not only eliminates the effect that the actuating arm had in maintaining the pins 48 and 50 and the upper and lower sections of the column 46 in vertical alignment, but the lower wall of the diagonal slot 52 cams the pins 48 and 50 away from the front wall of the liner 19, thereby collapsing the column 46 and causing the trailing end of the span 20 to fall into the pit 16. Motive devices other than solenoids, such as hydraulically or pneumatically operated fluid cylinders, can be used in connection with the actuating arm 54.

The pit 16 must be wider than the anticipated unauthorized vehicles and is preferably as wide as the road 12. The length of the pit 16 can be determined from the anticipated maximum speed of violating unauthorized vehicles and the distance necessary to have such vehicles fall by the time they reach the trailing wall of the liner 19. Of course, the span 20 should be a few inches longer than the pit 16, so that it rests on the shoulder 22. It has been calculated, for example, that a vehicle travelling at 30 miles per hour will fall about 1 foot if the span 20 is 10 feet long, and that the span 20 must be 35 feet long to cause a vehicle travelling at 50 miles per hour to fall about 4 feet.

Thus, it will be appreciated that, as a result of the present invention, an improved road block is provided by which the stated objective, among others, is fulfilled. Also, it will be understood from the preceding description that modifications may be made in the illustrated embodiments without departure from the invention. Accordingly, it is expressly intended that the foregoing description and accompanying drawings are illustrative only, not limiting, and that the true spirit and scope of the present invention is to be determined by reference to the appended claims.

I claim:

1. A road block for preventing the entry of selected vehicles into a secured area via a road, comprising:

a pit defined in part by a trailing wall on a trailing end of the pit with respect to the direction of vehicle access and a leading wall on a leading end of the pit, the pit having a width greater than the width of the selected vehicles;

means for supporting vehicles above the pit at a level even with the surface of the road during normal operating conditions, the supporting means comprising a span of predetermined length and of width narrower than the width of the pit, an abutment support supporting the leading end of the span and at least one collapsible support member supporting the trailing end of the span; and means for effecting free fall of the vehicle supporting means into the pit by collapsing the support member in response to a selected vehicle approaching the pit, whereby the trailing end of the span falls into the pit, directing the vehicle toward impact against the trailing wall of the pit.

2. The apparatus of claim 1, wherein the collapsible support comprises a support column extending between the span and the bottom of the pit.

3. The apparatus of claim 2, wherein the free fall effecting means includes an explosive charge secured to the support column and means for detonating the charge in resonse to a selected vehicle approaching the pit.

4. The apparatus of claim 3, wherein the explosive charge is an electrically detonated squib and the detonating means includes a switch actuated by a selected vehicle approaching the pit, said switch being electrically connected to the squib.

5. The apparatus of claim 3, further comprising a movable barrier across the road in advance of the leading end of the pit, wherein the detonating means comprises means for detonating the charge in response to movement of the movable barrier in a predetermined direction.

6. The apparatus of claim 3, wherein the pit has a rigid liner, and the support column is secured to the rigid liner by frangible fastening means.

7. The apparatus of claim 2, wherein the support column comprises a lower section and a separate upper section resting on said lower section in vertical alignment, and the apparatus further comprises means for maintaining the upper and lower sections in vertical alignment during normal operation.

8. The apparatus of claim 7, wherein the free fall effecting means the support member comprises the means for maintaining the upper and lower sections in vertical alignment.

9. The apparatus of claim 8, wherein the free fall effecting means comprises a power-operated member for eliminating the vertical alignment of the upper and lower sections of the support column.

10. The apparatus of claim 1, wherein the pit has a rigid liner.

11. The apparatus of claim 6, wherein the rigid liner has a wall adjacent the leading wall of the pit, and a shoulder is defined at the top of the rigid liner wall, the shoulder comprising the abutment support.

12. The apparatus of claim 1, wherein a shoulder is defined at the top of the leading wall, the shoulder comprising the abutment support.

13. The apparatus according to claim 1, further comprising camouflage means for rendering the road block undetectable by vision, said camouflage means including said vehicle supporting means.

14. The apparatus according to claim 13, wherein said camouflage means further includes a surface on said span matching the surface of the road.

15. The apparatus according to claim 1, further comprising means, spaced from said pit, for actuating said free fall effecting means.

16. A road block for preventing the entry of selected vehicles into a secured area via a road, comprising:

a pit defined in part by a trailing wall on a trailing end of the pit with respect to the direction of vehicle access and a leading wall on a leading end of the pit, the pit having a width greater than the width of the unauthorized vehicles;

means for supporting vehicles above the pit at a level even with the surface of the road during normal operating conditions, the supporting means comprising a span of predetermined length and width narrower than the width of the pit, and supports supporting the span, said supports including at least one collapsible support member;

camouflage means for rendering the road block undetectable by vision, and said camouflage means including said vehicle supporting means; and means for effecting free fall of the vehicle supporting means into the pit by collapsing the support member in response to a selected vehicle approaching the pit, whereby the trailing end of the span falls into the pit, directing the vehicle toward impact against the trailing wall of the pit.

17. The apparatus according to claim 16, wherein said camouflage means further includes a surface on said span matching the surface of the road.

18. A road block for preventing the entry of selected vehicles into a secured area via a road, comprising:

a pit defined in part by a trailing wall on a trailing end of the pit with respect to the direction of vehicle access and a leading wall on a leading end of the pit, the pit having a width greater than the width of the unauthorized vehicles;

means for supporting vehicles above the pit at a level even with the surface of the road during normal operating conditions, the supporting means comprising a span of predetermined length and a width narrower than the width of the pit, and supports supporting the span, said supports including at least one collapsible support member;

means for effecting free fall of the vehicle supporting means into the pit by collapsing the support member in response to a selected vehicle approaching the pit, whereby the trailing end of the span falls into the pit, directing the vehicle toward impact against the trailing wall of the pit; and means, spaced from said pit, for actuating said free fall effecting means.

* * * * *